US008696240B2

(12) United States Patent
Baas et al.

(10) Patent No.: US 8,696,240 B2
(45) **Date of Patent: *Apr. 15, 2014**

(54) WATERCRAFT LIFT

(75) Inventors: Brad Baas, Cambridge, MN (US); Brian V. Varsoke, Cambridge, MN (US)

(73) Assignee: Brian V. Varsoke, Cambridge, MN (US)

( * ) Notice: Subject to any disclaimer, the term of this patent is extended or adjusted under 35 U.S.C. 154(b) by 99 days.

This patent is subject to a terminal disclaimer.

(21) Appl. No.: 12/892,111

(22) Filed: Sep. 28, 2010

(65) Prior Publication Data

US 2012/0076585 A1 Mar. 29, 2012

(51) Int. Cl.
*B63C 1/08* (2006.01)

(52) U.S. Cl.
USPC ..... 405/3; 405/1; 405/4

(58) Field of Classification Search
USPC ..... 405/1, 2, 3, 4, 7
See application file for complete search history.

(56) References Cited

U.S. PATENT DOCUMENTS

| | | | | |
|---|---|---|---|---|
| 4,282,968 | A | 8/1981 | Temme | |
| 4,658,952 | A | 4/1987 | Griindken et al. | |
| 5,287,955 | A | 2/1994 | Steinkuhl et al. | |
| 5,290,124 | A * | 3/1994 | Pavlescak | 405/3 |
| 5,908,264 | A | 6/1999 | Hey | |
| 6,318,929 | B1 | 11/2001 | Basta | |
| 6,637,975 | B2 | 10/2003 | Foxwell | |
| 6,830,002 | B1 | 12/2004 | Walker | |
| 6,830,410 | B2 * | 12/2004 | Davidson et al. | 405/3 |
| 6,837,651 | B1 | 1/2005 | Basta | |
| 6,964,241 | B1 | 11/2005 | Krebs | |
| 6,964,540 | B1 | 11/2005 | Foxwell | |
| 7,153,059 | B2 | 12/2006 | Foxwell | |
| 7,246,970 | B2 | 7/2007 | Hey | |
| 2006/0147269 | A1 * | 7/2006 | Spratt et al. | 405/3 |
| 2008/0105181 | A1 * | 5/2008 | Radcliff | 114/44 |

* cited by examiner

*Primary Examiner* — Benjamin Fiorello
(74) *Attorney, Agent, or Firm* — Nikolai & Mersereau, P.A.; C. G. Mersereau

(57) ABSTRACT

A lightweight, knock-down portable watercraft lift or mooring device for small watercraft includes a modular freestanding frame having a pair of spaced supporting foot members, each foot member carrying a pair of spaced support members connected at one end to the foot member, a pair of rails carried by and connected to a second end of the support members. Both the spacing of between the support members and the length of the support members are adjustable allowing the distance between and height of the rails to vary to accommodate watercraft of different widths, water of different depths and create varying lift angles.

9 Claims, 5 Drawing Sheets

WATERCRAFT LIFT

CROSS REFERENCED TO RELATED APPLICATIONS

Not applicable

STATEMENT REGARDING FEDERALLY SPONSORED RESEARCH OR DEVELOPMENT

Not applicable

BACKGROUND OF THE INVENTION

I. Field of the Invention

The present invention relates generally to portable lifts or mooring devices for watercraft and, more particularly, to a lightweight, knock-down portable watercraft lift or mooring device for supporting watercraft out of the water for storage which is easily assembled, disassembled and transported.

II. Related Art

Small watercraft including personal watercraft have long been used by a very large number of people for a variety of purposes and on a variety of waterways. Uses have included sports such as racing and waterskiing, fishing and pleasure cruising. These uses take place on a variety of waterways including oceans, inland lakes and rivers and may involve using a watercraft in areas where typically there are no docking facilities or other provisions for securing or mooring the watercraft when it is not in use. This has led to the necessity, at times, of tying the watercraft to a tree along the shore or to a stake driven into the ground at the shore which allows the watercraft to remain in a vulnerable position with regard to repeated collisions with the bottom of the waterway or an adjacent bank. If docking facilities are available, in certain cases, tying the watercraft to a dock also exposes the watercraft to wakes and waves which may cause repeated contact with the dock which also can cause undesirable damage.

One alternative, of course, is to take the watercraft completely out of the water and store it, for example, on a trailer until the next use. This, of course, requires extra time-consuming labor and usually requires the watercraft to be returned to the spot where it was launched each time it is taken out of use.

Thus, it would clearly be desirable if a portable lift/mooring device were available which would enable the watercraft to be safely left at the edge of a waterway in a manner such that it would not be affected by the movement of the water. In addition, if such a device were lightweight and easily assembled and disassembled, it could be carried on the watercraft so that the watercraft could be stored on the watercraft lift at any location desired by the user.

SUMMARY OF THE INVENTION

By means of the present invention there is provided a lightweight, knock-down, portable watercraft lift or mooring device for small watercraft which includes a stable free-standing frame of a modular design which can be readily assembled and disassembled. The frame is provided with multiple adjustments to accommodate different hull width configurations and includes height adjustments for varying water depths and bottom slopes. The system is made of lightweight material so that it is quite portable and easily moved by one person in an assembled or disassembled state.

One embodiment of the free-standing frame includes a pair of spaced generally parallel foot members which are generally horizontally disposed in use assuming the frame is on a flat or gently sloping surface. A pair of spaced support members are designed to connect at one end to each of the foot members and extend in a generally vertical direction. The support members carry a pair of top rails extending and defining the distance between the spaced supporting foot members. The rails are designed to support a watercraft just above the water line when the watercraft is not in use. The spacing of the rail support members along the foot members is adjustable and includes multiple locations to account for different watercraft hull width configurations. The length of the spaced support members is also provided with multiple adjustments to adjust the height of the top rails to account for varying water levels. The frame may be provided with one or more supporting cross straps or strut members to add stability and strengthen the frame for supporting the watercraft.

The components of the frame of the watercraft lift are preferably assembled utilizing only removable components such as cap screws, hex nuts and lock pins which makes assembly and disassembly fast and easy. Certain connections may incorporate threaded fasteners connected by "dog bone" connectors in a unique manner. The system is designed so that additional modules can be added to increase the length of the watercraft lift and the support rails of the modules can be provided in various lengths to accommodate varying lake bottoms, shore lines and watercraft sizes. It will further be appreciated that the modular watercraft lift frame of the invention can also be used, for example, to support dock sections.

While other materials can be used, a preferred embodiment utilizes round or oval metal (preferably selected from aluminum, magnesium or alloys of aluminum or magnesium alloys and a polymer material) tubing for the foot members and top rails and telescoping rectangular or square tubular sections, also preferably aluminum, for the support members. Adjustment is accomplished by a series of spaced bores along the foot members and telescoping support members which provides the ability to quickly adjust both height and width of the frame assembly.

BRIEF DESCRIPTION OF THE DRAWINGS

In the drawings wherein like reference characters designate like parts throughout the same.

DETAILED DESCRIPTION

The following detailed description is directed to details of one or more embodiments capturing the concepts of the present invention. The embodiments are meant as examples and are not meant to limit the scope of the invention in any manner.

Figure 1:
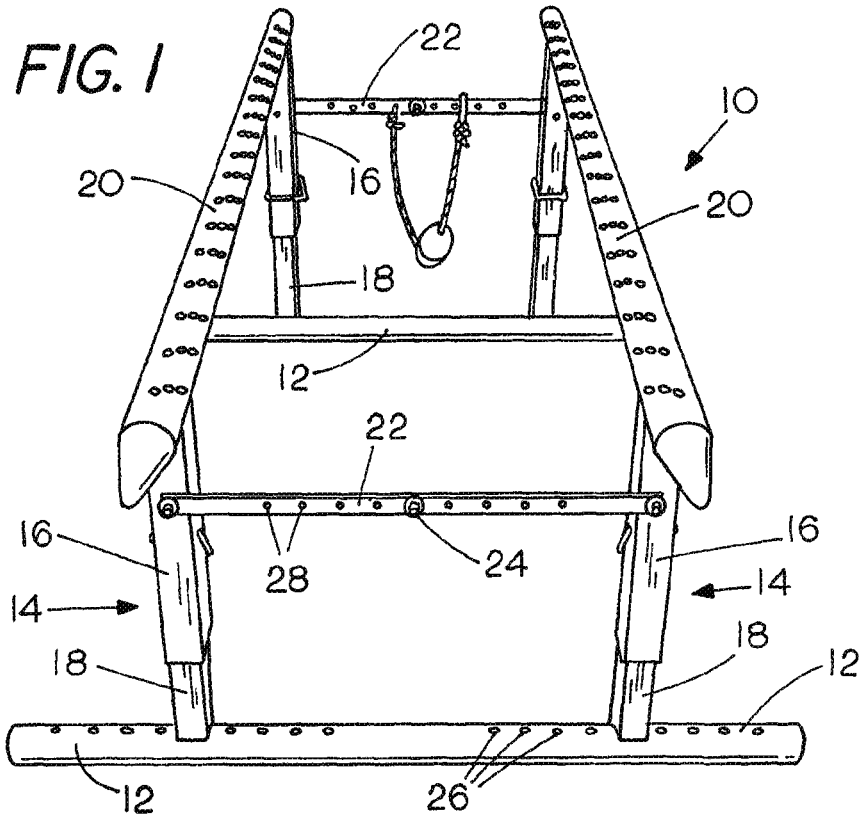
FIG. 1 shows an embodiment of the watercraft lift of the present invention in an assembled form.

In FIG. 1, there is shown generally at 10 an assembled embodiment of a watercraft lift device in accordance with the present invention. It includes a pair of spaced foot members 12, each of which carries a pair of spaced support or leg members 14 having upper and lower telescoping sections 16 and 18, respectively. Rail members 20 are mounted on top of the support members thereby defining the distance between the foot members 12 or the length of the frame. One or more support members or support straps as at 22 may be provided to add stability to the watercraft lift frame. A connector suitable for connecting a winch brace is shown at 24. Lubrication for watercraft sliding along rail members 20 is provided by low friction plastic buttons 25 which may be made from, for example, high density or ultra high molecular weight polyethylene, polytetrafluoroethylene (PTFE) sold under the trademark Teflon® or other suitable stable polymer material.

Figure 2:
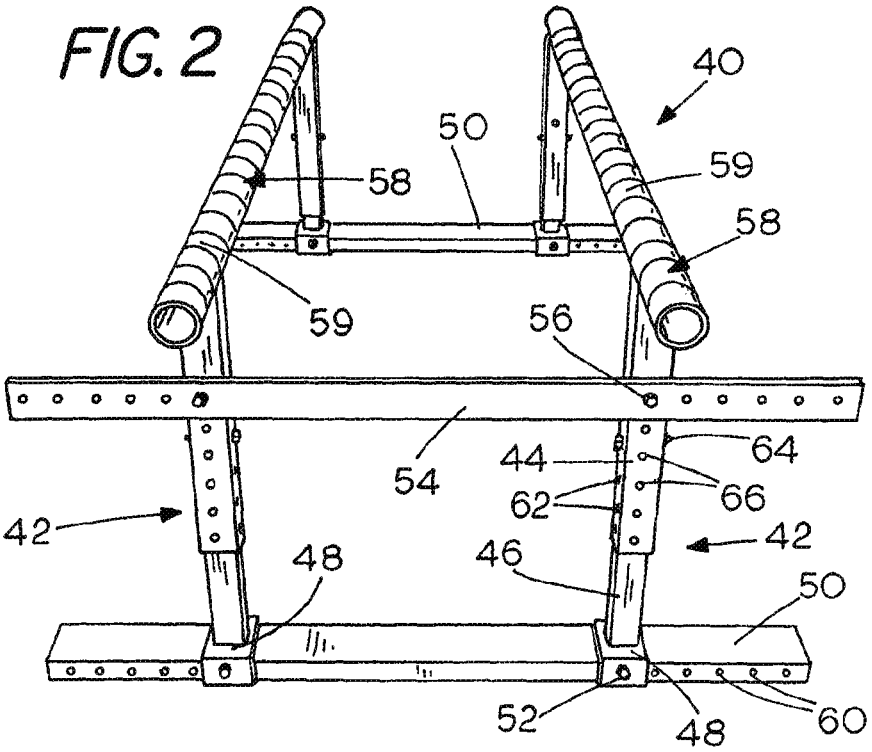
FIG. 2 shows an alternate embodiment of the watercraft lift of FIG. 1.
Figure 5:
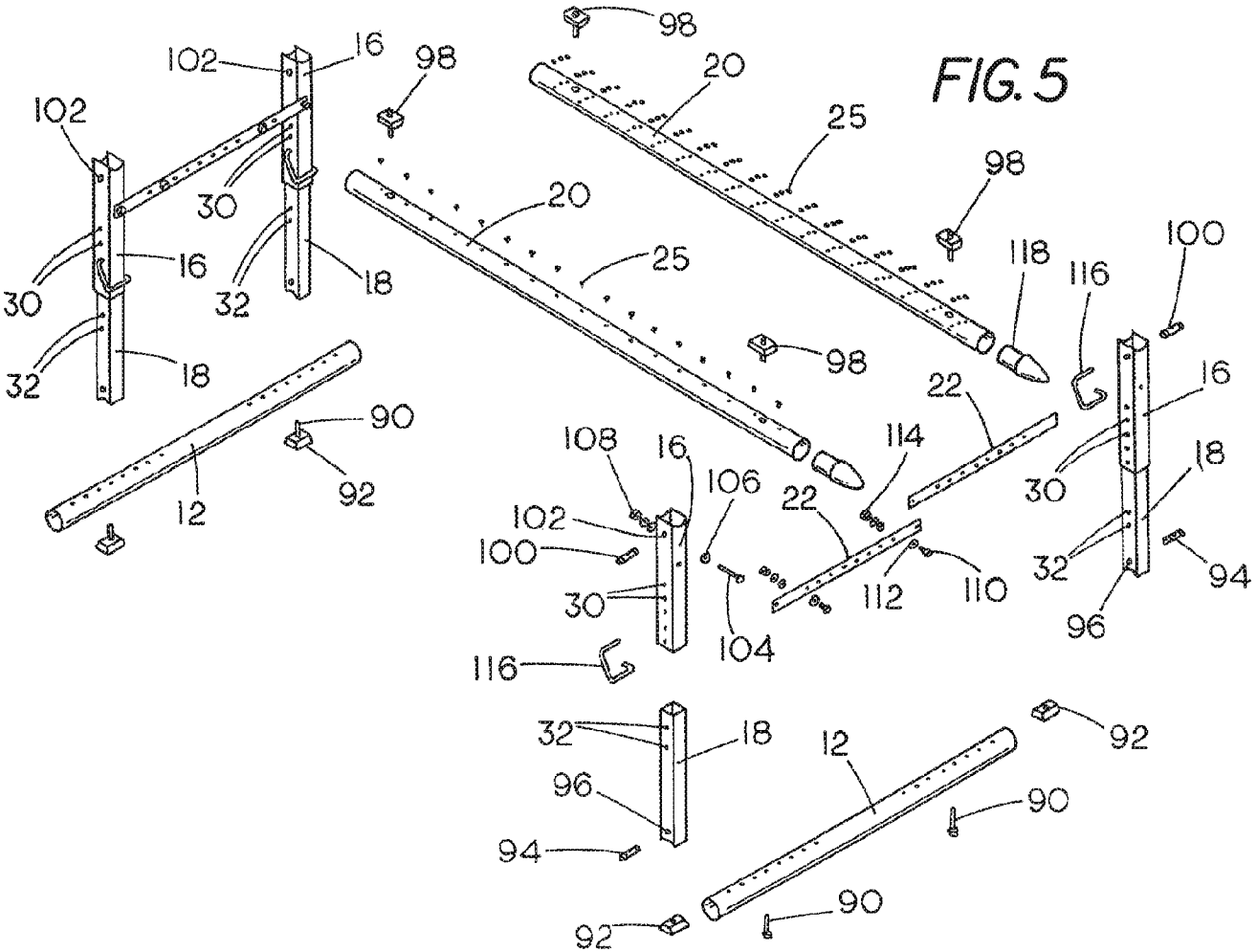
FIG. 5 is an exploded view showing parts of an embodiment of the present invention.
Figure 6:
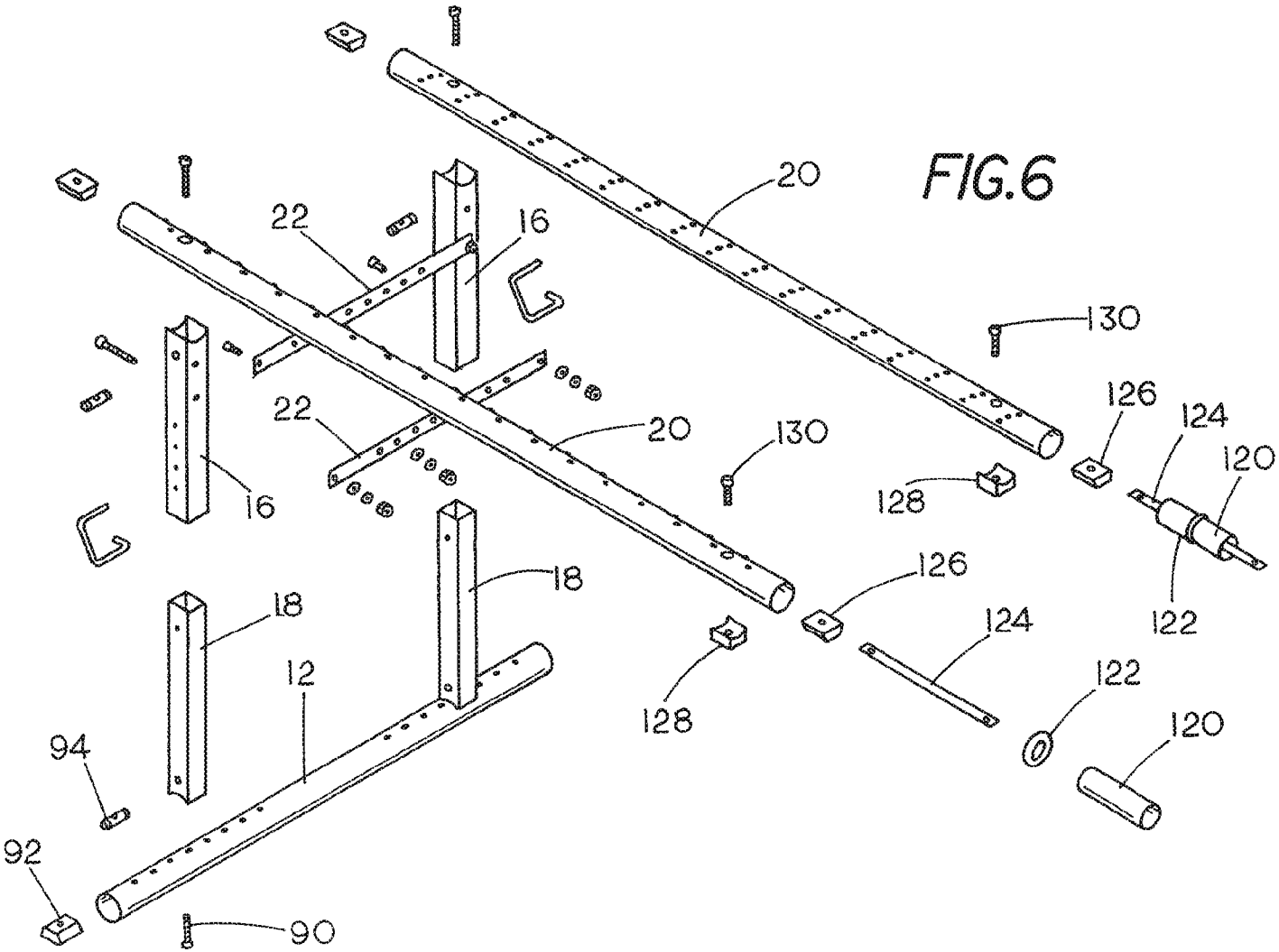
FIG. 6 is a second exploded view of parts of an embodiment of the present invention showing connecting devices for modular add-on sections.

The width of the assembly is readily adjusted using a plurality of attachment apertures or bores 26 spaced along the foot members which align with bores or openings 28 in the cross-bracing strap members 22. As best seen in FIGS. 2, 5 and 6, vertical telescoping sections 16 and 18 of support members 14 also are provided with spaced bores along a portion of the length of each at 30 and 32, respectively, to provide multiple telescoped positions to adjust the height of the rail members. It should be noted that one end of the structure can be adjusted to a height different from the other end and in some embodiments, the width can differ from end to end.

FIG. 2 shows a slightly different embodiment at 40 in which the support members 42 have upper sections 44 and lower sections 46. The lower sections 46 are welded to sleeves 48 which, in turn, are bolted to rectangular tube members as at 52. An adjustable strap member or stent is shown at 54 connected as at 56 to upper support section. The support rails 58 are made from aluminum pipe or tubing, or the like. Lubrication for watercraft sliding along rail members 58 is provided by low friction plastic tape which may be made from, for example, high density or ultra high molecular weight polyethylene, polytetrafluoroethylene (PTFE) sold under the trademark Teflon®.

The sleeves 48 are adjustable along members 50 using spaced bores 60 and the support members are of adjustable telescoping construction using bores as at 62 and bolts 64.

The cross struts or straps are vertically adjustable using spaced bores 66.

Figure 3:
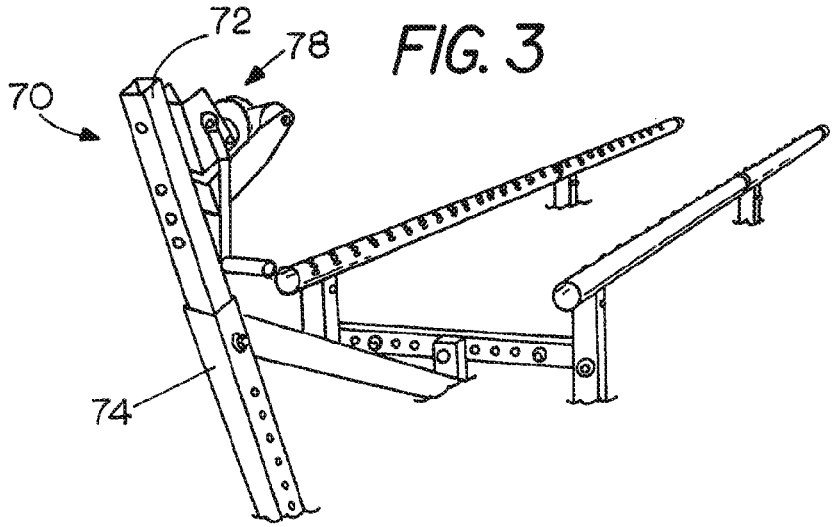
FIG. 3 depicts an embodiment similar to that of FIG. 1 with a winch assembly and a support rail extension assembly attached.
Figure 4A:
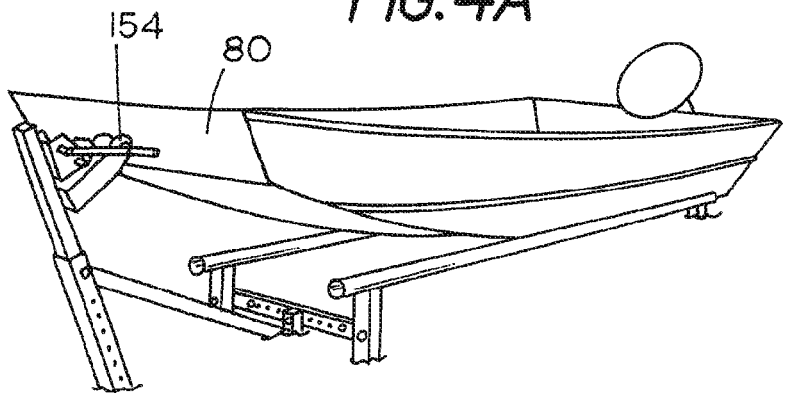
FIGS. 4A and 4B are views similar to that of FIG. 3 showing the lift carrying types of watercraft.
Figure 4B:
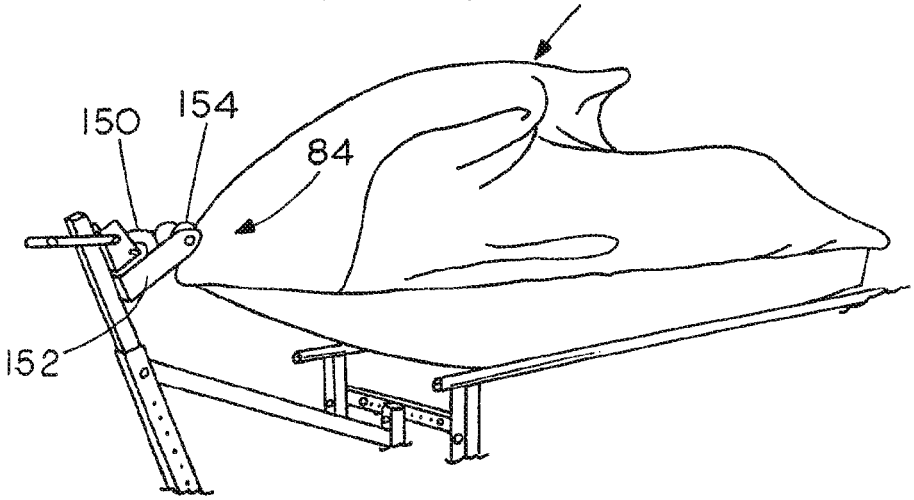

FIG. 3 depicts an embodiment similar to that depicted in FIG. 1 situated in lake water alongside of a dock and with a telescoping boom 70 attached to the frame with relatively adjustable sections 72 and 74 and a supporting strut. A winch mechanism is shown at 78. FIG. 4A depicts the embodiment of FIG. 3 with a fishing boat type watercraft 80 mounted on the watercraft lift. FIG. 4B depicts a personal watercraft (PWC) 92 mounted on the watercraft lift. A winch assembly is shown at 84 in both FIGS. 4A and 4B. In FIGS. 3 and 4, note that the front of the watercraft lift (near side) is raised relative to or in shallower water than the far end.

FIGS. 5 and 6 further depict exploded or blown apart views of an embodiment similar to those of FIGS. 1 and 3. The telescoping support members 14 are attached to the foot members 12 in a unique manner that avoids the need for permanent welded sleeves as at 48 in FIG. 2. The attachment system includes threaded fasteners such as cap screws 90 threaded through retainers 92 to secure the lower telescoping sections 18 using "dog bone" connector members 94 inserted into openings 96 through the members 18.

Similarly, the rail members 20 are connected to the upper telescoping sections 16 using cap screws 98 and dog bone connectors 100 inserted through members 16 at 102. Straps on struts 22 are attached using cap screws 104 with washers 106 and hex nuts 108. Two of the support straps or struts may be fastened together as shown in FIGS. 5 and 6 using cap screws, washers 112 and nuts 114. The upper and lower support sections may be adjustably joined using gravity lock pins 116.

In FIG. 5, the watercraft lift system is shown as provided with bullet end caps 118. In the embodiment of FIG. 6, the bullet end caps 118 are replaced by a connection system for adding additional consecutive sections. The connection system includes connector tubes 120, connector tube bushings 122, retainer bars 124, retainers 126, saddles 128 and hex head socket cap screws 130. It should be noted that frame sections of different lengths, i.e., different lengths of rails 20 can be combined to put together watercraft lifts of various desired lengths.

As can be seen, particularly with regard to the exploded views of FIGS. 5 and 6, the watercraft lift of the invention can be assembled and disassembled easily and quickly using only a tool to tighten and loosen cap screws.

Figure 7:
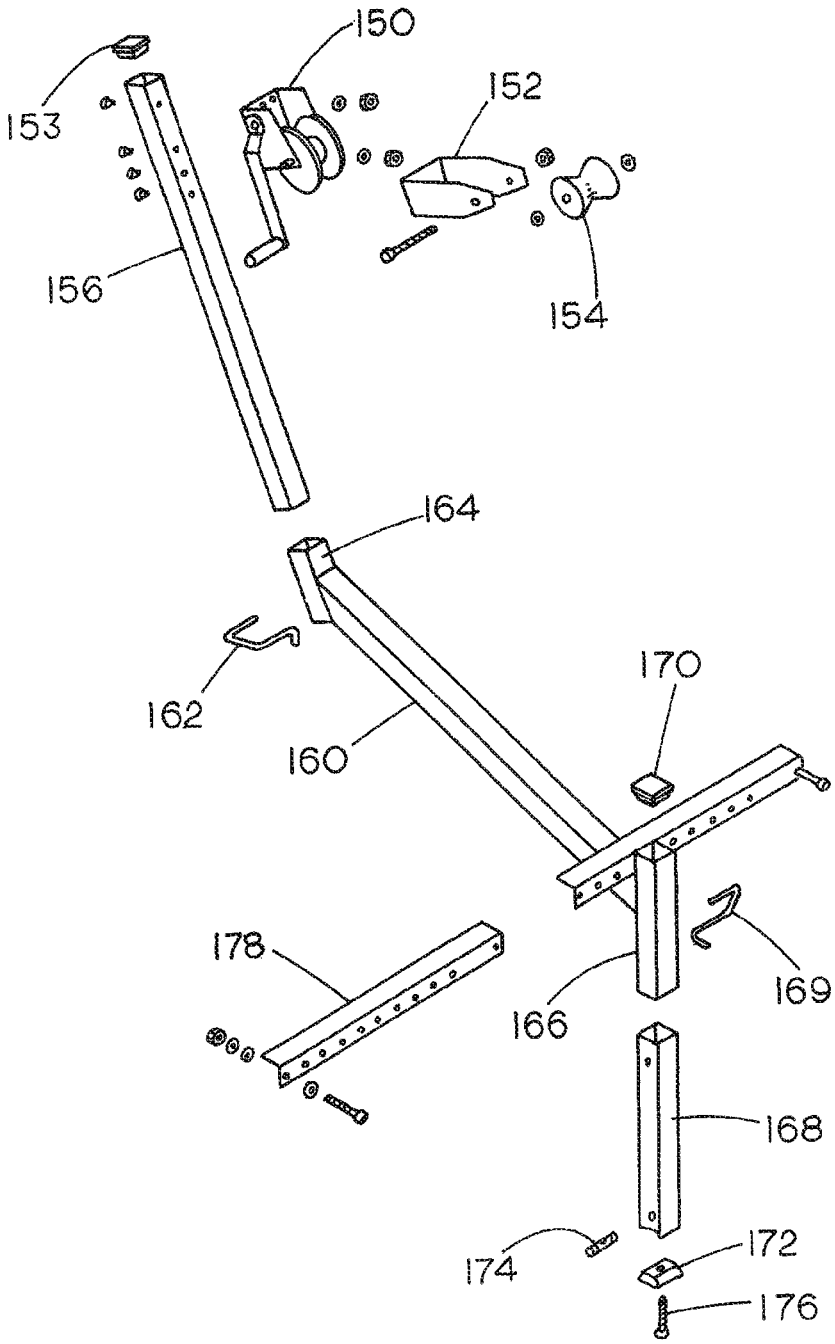
FIG. 7 is an exploded view of a lift winch assembly for use with the watercraft lift of the invention.

FIG. 7 depicts a further exploded view of a winch assembly that can be used with the watercraft lift of the invention and as pictured assembled and mounted at 84 in FIGS. 4A and 4B. The winch device includes a hand crankable winch pulley element 150, a bumper roller mount 152 with a bumper roller 154 that contacts a fully lifted watercraft mounted to it as shown in FIGS. 4A and 4B. The winch is attached to an upper winch support tube member 156 suitably capped by a plug 153. The upper winch support member 156 is attached to a middle support member 160 by a lock pin 162. The middle support tube member 160 is attached to integral tube members 164 and 166. Lower member 166 is, in turn, attached to a lower support tube member 168 as by a lock pin 169 and is capped by a plug 170. Lower support 168 is mounted to a frame foot member (as at 12 in FIG. 5 or 6) by means of a retainer 172, dog bone member 174 and cap screw 176. A further winch support strap is shown at 178.

An adjustable watercraft lift constructed in accordance with the present invention can be used to accommodate and support watercraft weighing up to and possibly more than 1200 pounds by simply adjusting the frame. Personal watercraft (PWC's) can be driven onto the frame without help. Winch systems can be incorporated if desired for larger watercraft.

Smaller units with 18-inch leg sections and 6-foot support rails weigh less than 50 pounds and can be easily assembled and moved by one person, disassembled and packed down to be stored or stowed for travel.

The modular design add versatility to the lift enabling accommodation of longer watercraft with the addition of winches and accessories. Different foot pad designs can be used to accommodate different types of lake bottoms. If desired, attaching devices can be provided to docks or floating devices and sandbag, auger or other anchoring devices can be used with the lift.

As indicated, forward and rear frame heights can be adjusted to create the ideal angle of incline for supported watercraft. This is important particularly for small watercraft so that rain water collecting in the watercraft can be drained easily. The system enables watercraft to be stored off shore next to a dock ready for immediate use instead of being stored on shore. In addition, the angle of incline enables stored watercraft to slide freely back into the water when desired.

An aspect of the invention that is noteworthy is that the watercraft lift of the invention requires no moving parts. The need for rollers and associated bearings which require maintenance has been eliminated. The system of buttons on the support rails produces a low coefficient of friction and radial placement of the buttons as shown in the figures accommodates transitional (front-to-back) watercraft hull configurations. This important aspect of the watercraft lift also results in a significant cost reduction.

Another important aspect of the watercraft lift construction that reduces the cost of the device and aids in the case of disassembly and parts storage or packing of parts is the use of dog bone connection assemblies. They eliminate the need for welding sleeve joints on the legs or support members and enable the legs to break down into smaller parts for packing and storage.

It is further contemplated that the watercraft lift of the invention can be packaged and sold as a kit of parts and that models of varying sizes and materials can be produced.

This invention has been described herein in considerable detail in order to comply with the patent statutes and to provide those skilled in the art with the information needed to apply the novel principles and to construct and use embodiments of the example as required.

However, it is to be understood that the invention can be carried out by specifically different devices and that various modifications can be accomplished without departing from the scope of the invention itself.

What is claimed is:

1. A knock-down portable watercraft lift structure or mooring device for watercraft comprising a modular freestanding metal frame further said frame comprising:

(a) a bottom support in the form of a pair of elongated bottom support members desiyned to rest on the bottom of a body of water and support the watercraft lift structure;

(b) a pair of spaced upward extending support members carried on and spaced by each of said bottom support members, connected at a first, lower true end to said bottom support member and extending generally vertically upward therefrom; and (c) a pair of rails, each carried by and connected to a second, upper true end of one of said upward extending support members associated with each of said bottom support members whereby the connections of said rails determine the spacing of said supporting bottom support members and wherein both the spacing of said upward extending support members along said bottom support members and length of said upward extending support members are adjustable allowing the distance between and height of the rails to vary to accommodate watercraft of different widths, water of different depths and to create varying life angles.

2. The watercraft lift as in claim 1 wherein said upward extending support members are of a telescoping construction.

3. The watercraft lift as in claim 1 wherein said rails include a pattern of friction reducing buttons on the surface thereof.

4. The watercraft lift as in claim 1 further comprising a winch mechanism mounted on the frame for moving a watercraft onto the frame.

5. The watercraft lift as in claim 1 further comprising stabilizing members connected between said spaced upward extending support members spaced from said bottom support members.

6. The watercraft lift as in claim 1 wherein said bottom support, rail and upward extending support members are of a tubular metal construction.

7. The watercraft lift as in claim 6 wherein said tubular metal selected from the group consisting of aluminum, alloys of aluminum or magnesium alloys.

8. The watercraft lift as in claim 1 wherein said modular free-standing frame of said watercraft lift is adapted to receive addition modular free-standing frames.

9. The watercraft lift as in claim 1 wherein said frame is constructed of a material selected from aluminum, aluminum alloys and magnesium alloys.

* * * * *